US005347421A

United States Patent [19]

Alexanian

[11] Patent Number: 5,347,421

[45] Date of Patent: Sep. 13, 1994

[54] LAW ENERGY SOLENOID ENERGIZER

[76] Inventor: George Alexanian, 7255 N. Geraldine, Fresno, Calif. 93711

[21] Appl. No.: 992,129

[22] Filed: Dec. 17, 1992

[51] Int. Cl.[5] ..... H01H 47/04

[52] U.S. Cl. ..... 361/156; 361/166; 361/195; 361/154

[58] Field of Search ..... 251/129.01, 129.04, 251/129.05, 129.09, 129.15; 361/154, 155, 156, 166, 189, 191, 194, 195, 210; 307/115, 139, 140, 141

[56] References Cited

U.S. PATENT DOCUMENTS

| | | | |
|---|---|---|---|
| 3,365,622 | 1/1968 | Pearse | 361/156 |
| 3,723,827 | 3/1973 | Griswold et al. | 361/166 |
| 3,895,269 | 7/1975 | Geremia | 361/189 |
| 4,054,935 | 10/1977 | Ginsberg | 361/189 |
| 4,262,320 | 4/1981 | Herron | 361/191 |
| 4,418,374 | 11/1983 | Callan | 361/167 |
| 4,651,777 | 3/1987 | Hardman | 251/129.04 X |
| 4,679,766 | 7/1987 | Cuming | 361/154 X |
| 4,716,490 | 12/1987 | Alexanian | 361/155 |
| 4,718,454 | 1/1988 | Appleby | 361/156 |
| 5,099,384 | 3/1992 | Chin | 361/166 |

FOREIGN PATENT DOCUMENTS

| | | | |
|---|---|---|---|
| 2834780 | 2/1980 | Fed. Rep. of Germany | 361/156 |
| 52-23249 | 2/1977 | Japan | 361/156 |
| 1-248424 | 10/1989 | Japan | 361/156 |

*Primary Examiner*—A. D. Pellinen
*Assistant Examiner*—Fleming F. M.
*Attorney, Agent, or Firm*—Mark D. Miller

[57] ABSTRACT

A device including a circuit for energizing a latching solenoid from an AC power source which separates the latching solenoid from the AC power circuit. The device provides for reliable operation of the latching solenoid, and may be separated from the AC power source by several thousand feet of high gauge (lower cost) wire. The device operates on low AC voltage and current making it highly energy efficient.

13 Claims, 2 Drawing Sheets

LAW ENERGY SOLENOID ENERGIZER

BACKGROUND OF THE INVENTION

The present invention relates to solenoid actuators, and more particularly to a new and improved device that allows a latching solenoid to be used in an alternating current (AC) environment requiring very little voltage or current.

FIELD OF THE INVENTION

In the field of watering systems, low voltage solenoids are commonly used as actuators to open and close water valves. A solenoid enlisted for such a purpose is generally situated in close proximity or attached to the valve it is to control. In commercial agricultural and horticultural situations, such valves may be in remote locations that can be hundreds or even thousands of feet from the nearest AC power source. Insufficient voltage or current at the valve is a common problem where long distances or multiple valves are involved.

Normally, irrigation systems use 24 volts AC root-mean-square (RMS) to control electric solenoids. Reliable operation of the solenoids is essential to ensure that water is regularly delivered to plants. For reliable operation a 24 volt AC solenoid will require a minimum of about 20 volts AC. Thus, the voltage on the line at the solenoid must not drop below 20 volts AC or the solenoid may not activate. AC voltage drops over long runs of wire according to the formula:

$$Vd = I \times R \times L$$

wherein

Vd=voltage drop in volts

I=current load in amps

R=resistance factor (ohm/1000 feet)

L=length of wire in thousands of feet.

Thus, as the length (L) of the wire to the solenoid is increased, Vd increases proportionally, resulting in lower voltage at the solenoid.

The conventional solution to the problem of voltage drops over long runs of wire is to provide thick, low-gauge solid wire (e.g. 8 gauge solid copper wire) which has a lower resistance factor (R) than the thinner, higher-gauge wire. This solution provides a reliable method of controlling remote solenoids by decreasing Vd. However, the high cost of long runs of low-gauge wire becomes prohibitive, especially when several runs are required to operate several remote solenoids simultaneously.

A second option is to provide direct current (DC) voltage through long runs of copper wire to the solenoids. However, the galvanic effect of the inductive field created by buried wires carrying DC current causes the copper in the wires themselves to deteriorate over time, resulting in unreliability and eventually requiring replacement.

A third option is to provide a DC power source at the same remote location as the valve itself utilizing on-site batteries, solar power, or an on-site diesel generator. The disadvantage of this approach is the high cost of a self-contained remote system, and the problems of reliability in the event batteries or generator fail, or the weather is overcast for several days.

My 1987 patent (U.S. Pat. No. 4,716,490) addresses these problems to some extent by providing a power saving module in the form of a local circuit for energizing a solenoid. With the U.S. Pat. No. '490 device, less initial voltage and current is required to cause the solenoid to activate. Unfortunately, after initial activation, the solenoid in the U.S. Pat. No. '490 device remains in the circuit so that a constant current must continue to flow through the solenoid to keep it open. When the voltage drops off, the solenoid in the U.S. Pat. No. '490 device closes. The continuous flow of current through the solenoid exposes it to possible overheating and failure.

The device disclosed in U.S. Pat. No. 4,679,766 provides a different solenoid activation circuit from the U.S. Pat. No. '490 device, but suffers from the same drawback that current must continue to flow through the circuit in order to keep the solenoid open. Only a very limited selection of coils and solenoids are available that will function properly when barely energized in this way. Small variations in input voltages, coils, springs, line losses, and changes in water pressure could cause malfunctions. In addition, the electronic design of U.S. Pat. No. '766 makes it much more susceptible to lightning transients than the passive electro-mechanical mechanism herein proposed.

SUMMARY OF THE INVENTION

The present invention is a much better solution to the distance and power problems presented in existing solenoid actuator technology by providing a reliable circuit in close proximity with a latching solenoid that may be attached to an AC power source. The circuit of the present invention allows a low AC current to activate and deactivate the solenoid, so that longer runs of smaller size wire may be used between the AC power source and the solenoid.

The solenoid itself is of the latching variety, which means that once it is activated (opened), it remains that way without the requirement of a constant current running through it. A means is provided for separating the solenoid from the input voltage to the invention. Thus, there is no current constantly flowing through the solenoid itself. Instead, only a trickle of current is required in the circuit separate from the solenoid in order to keep a relay activated and the solenoid open. This configuration also provides the added benefit of extending the life of the solenoid since the coil thereof is not exposed to constant current which might result in overheating and failure.

The circuit also provides a different means for deactivating the latching solenoid when the trickle of power to the circuit is removed that is also separated from the input voltage to the invention. Thus, the present invention is not the "booster" of the U.S. Pat. No. '766 patent, but is instead a way of separating the latching solenoid from the input power source so that it may be activated and deactivated in a reliable way at a very low voltage and current.

It is therefore a primary object of the present invention to provide a reliable remote circuit that may be attached to a small gauge wire from a distant AC power supply for use in operating a latching solenoid attached to a water supply valve.

It is a further important object of the present invention to provide a reliable remote AC circuit for use in operating a solenoid attached to a water supply valve which saves energy by requiring very low current to operate the solenoid.

It is a further important object of the present invention to provide a reliable remote AC circuit for use in operating a latching solenoid attached to a water supply valve requiring a very low current to activate or deactivate the latching solenoid, and an even lower current to maintain the latching solenoid in an activated (open) state.

It is a further object of the present invention to provide a circuit in close proximity to a latching solenoid that may be attached to a distant AC power source in order to operate said solenoid using low activation and deactivation current, and an even lower maintenance current.

It is a further object of the present invention to provide a reliable circuit for operating a latching solenoid that may be attached to an AC power source over a long run of high gauge (low cost) copper wire.

It is a further object of the present invention to provide a remote device for operating a latching solenoid attached to a water supply valve that allows a large solenoid (and hence a large water valve) opening to be maintained.

It is a further object of the present invention to provide a remote device for operating a latching solenoid that is relatively independent of electrical and/or mechanical variations of the voltage in the line.

It is a further object of the present invention to provide a remote device for operating a latching solenoid that allows for considerable savings in the costs for electric current and the costs associated with great lengths of low gauge or larger wire.

It is a further object of the present invention to provide a remote circuit for operating a latching solenoid that separates the solenoid from the current present in the circuit thereby eliminating a common cause of solenoid failure due to overheating.

It is a further object of the present invention to provide an AC circuit for operating a latching solenoid.

DETAILED DESCRIPTION OF THE DRAWINGS

Figure 1:
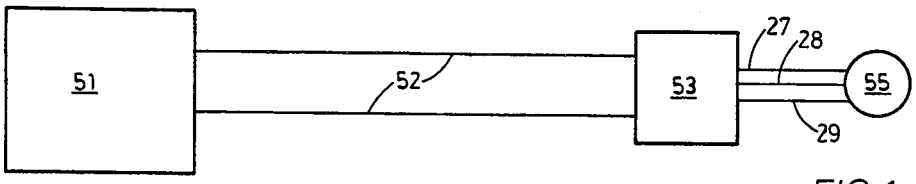
FIG. 1 is diagram showing the relative positions of the irrigation controller, actuator module of the present invention, and latching solenoid.
Figure 2:
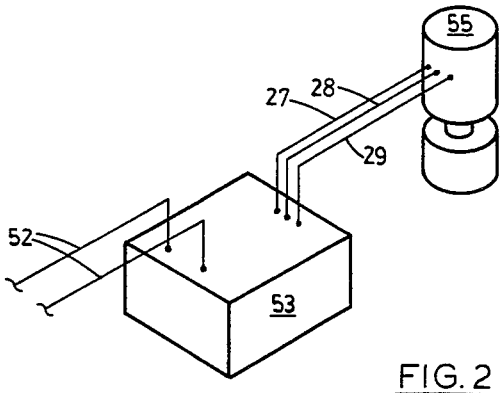
FIG. 2 is a diagram showing the actuator module of the present invention as it would be typically attached to an electric solenoid.
Figure 3:
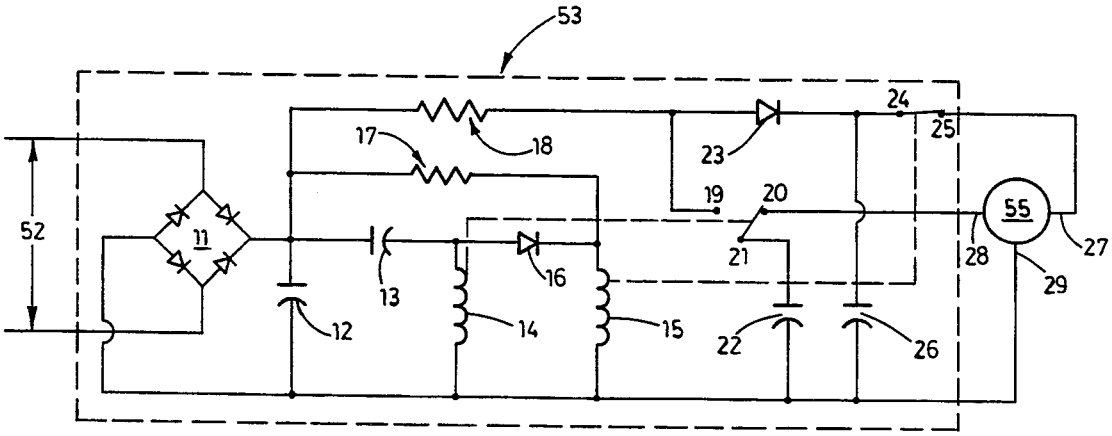
FIG. 3 is a schematic diagram of an actuator circuit of the present invention for use in a commercial environment.

Referring to the drawings wherein like reference characters designate like or corresponding parts throughout the several views, and referring particularly to FIGS. 1, 2 and 3, it is seen that the invention includes a circuit 53 having AC input leads 52 from AC power source (or controller) 51. Latching solenoid 55 is attached to the circuit 53 by three (3) leads, including an activation input lead 28, a deactivation input lead 27 and a common lead 29.

Circuit 53 receives 24 volts AC RMS through leads 52. The length of leads 52 can be from a few feet to tens of thousands of feet, separating the AC power source 51 from the circuit 53 itself.

Referring specifically to FIG. 3, it can be seen that as AC power enters the circuit over leads 52 it is applied to a full wave bridge rectifier 11 which converts the power from AC to DC. A charge storage means (capacitor) 12 acts as a filter.

As the DC current reaches capacitor 13, it briefly conducts across said capacitor 13 as it charges thereby activating relays 14 and 15. Relay 14 controls contacts 19, 20 and 21. Relay 15 controls contacts 24 and 25. The activation of relay 14 causes contacts 19 and 21 to close, thereby allowing current to flow through resistor 18 and charge capacitor 22. Simultaneously, the activation of relay 15 causes contacts 24 and 25 to open allowing current to flow through resistor 18 and charge capacitor 26.

After about four time constants (a few seconds), capacitor 13 becomes fully charged resulting in an open circuit to relay 14, releasing it. The release of relay 14 causes contact 19 to return to its normally closed position 20. This results in a closed loop and the discharge of capacitor 22 directly into input activation lead 28 of the latching solenoid 55. This activation discharge loop including solenoid 55 is completely separate from the input power circuit. The relays, capacitors and resistors are selected in such a way that capacitor 13 allows sufficient delay for capacitors 22 and 26 to charge fully through resistor 18, enabling them (22 and 26) to trip solenoid 55.

Even after capacitor 13 is charged, relay 15 remains activated by means of resistor 17. Diode 16 prevents relay 14 from seeing the current which keeps relay 15 activated. Resistor 17, allows a very low voltage to keep relay 15 activated. No more than about 20% of the nominal relay coil voltage is needed to keep a relay (such as 15) activated.

Because solenoid 55 is of the latching type, once it is activated (open), it remains so activated until a separate charge is sent to it through lead 27. Thus, as long as a very low voltage keeps relay 15 activated, the solenoid remains latched open.

When the voltage to relay 15 drops out (because it is cut off from the controller 51 across input leads 52), contacts 24 and 25 close, completing a loop which allows capacitor 26 to discharge into lead 27 of solenoid 55. Diode 23 prevents the discharge of capacitor 26 from going away from the solenoid 55. This discharge deactivates (closes) the solenoid 55. As with capacitor 22, so long as resistor 18 and capacitors 13 and 26 are properly selected, a sufficient charge can be built up in capacitor 26 from a very low power source to trip solenoid 55 when that charge crosses lead 27.

An advantage to this design is that if there is adequate charge to latch the solenoid, it is also enough to release it, since it takes a smaller charge to release than to latch. This is true because the solenoid has an internal spring that helps to release it.

Figure 4:
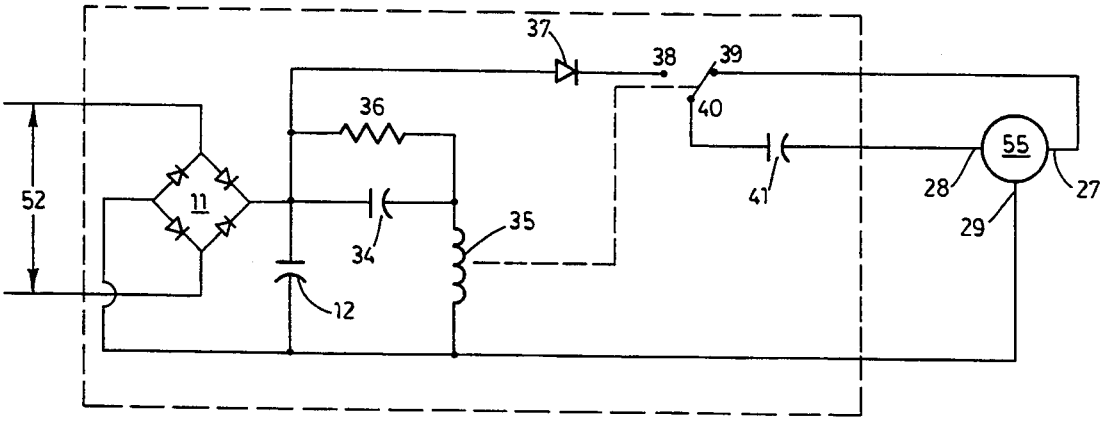
FIG. 4 is a schematic diagram of an alternative actuator circuit of the present invention for use in a residential, non-commercial environment.

In the alternative embodiment of FIG. 4, input leads 52 pass into rectifier 11 and across filter capacitor 12. As capacitor 34 is charged relay 35 is activated closing contacts 38 and 40. This allows DC current to pass across capacitor 41 to input lead 28 of solenoid 55. When capacitor 41 becomes fully charged, the current to lead 28 is cut off. This embodiment of the invention differs from the preferred embodiment in that DC current is allowed to travel directly from the power source 51 to the latching solenoid 55. Since the activating DC current is not collected or discharged through a capacitor in this embodiment, the DC current must be sufficiently high to trip the solenoid 55. Thus the DC current requirements of this embodiment are higher than the preferred embodiment discussed above.

The alternative embodiment is advantageous in that it allows for domestic use of latching solenoids on an AC circuit. It is useful only for wires 52 having moderate length such as those found in the yard or garden of a home. Nevertheless, this embodiment has a much lower power requirement than current non-latching solenoids for the same use.

In the alternative embodiment, low level current passing across resistor 36 keeps relay 35 activated. When the current drops out, relay 35 is deactivated resulting in the closure of contacts 39 and 40. This closure allows capacitor 41 to discharge into deactivation lead 27 of solenoid 55 causing it to trip closed.

Figure 5:
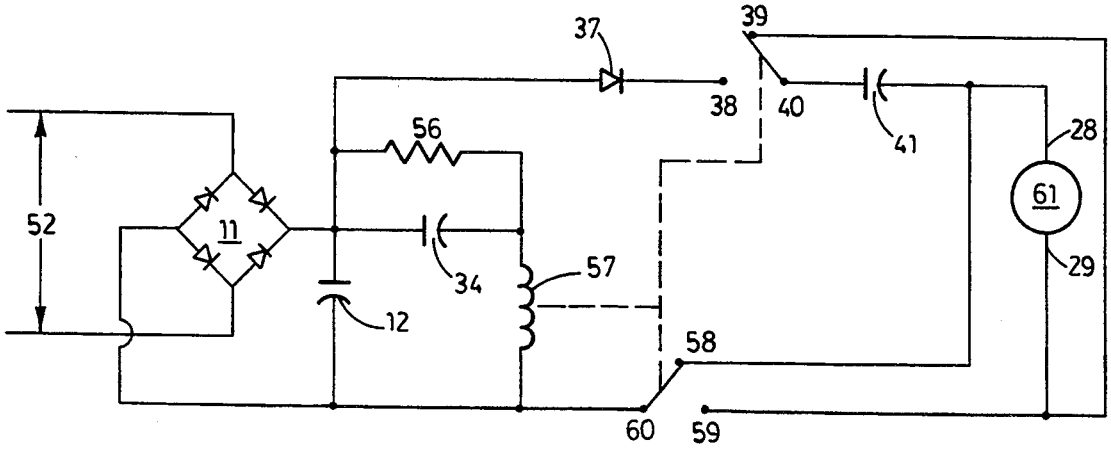
FIG. 5 is a schematic diagram of another alternative embodiment of the circuit of the present invention using a polarity reversing relay to activate a two-leaded latching solenoid.

A second alternative embodiment is also provided as shown in FIG. 5. This second embodiment utilizes a two-wire latching solenoid 61, instead of a three-wire latching solenoid 55 of the previous embodiments. Once activated, a reversal of polarity is required in order to deactivate such a solenoid 61. This is accomplished through relay 57 which operated double pole, double throw contacts 38-39-40 and 58-59-60 simultaneously.

As voltage is applied across leads 52 in FIG. 5, relay 57 is activated through capacitor 34 and remains activated through resistor 56. The activation of relay 57 simultaneously closes contacts 38 and 40 as well as contacts 59 and 60. The DC voltage passes through capacitor 41 when these contacts are made, latching solenoid 61 through input lead 28. When capacitor 41 becomes fully charged, the current flowing to the solenoid is interrupted. Diode 37 prevents the discharge of capacitor 41 from going away from the solenoid 61. When voltage across leads 52 is removed, relay 57 drops out simultaneously causing contacts 39 and 40 as well as 58 and 60 to be made. This results in the positive pulse discharge from capacitor 41 to be applied to the ground lead 29 of solenoid 61, and places a ground to lead 28 (originally the activating lead). This reversal of polarity causes two-lead single coil latching solenoid 61 to release.

DESCRIPTION OF THE PREFERRED EMBODIMENTS

The preferred embodiment shown in FIG. 3 is best illustrated by an example of the savings achieved.

1. Power savings a. A typical residential solenoid draws about 0.25 amp continuously to operate. The present invention requires about 0.025 amps to operate. Thus, a ninety percent (90%) savings in electricity is achieved.

b. A typical commercial or agricultural solenoid draws about 0.7 amps to operate. The present invention therefore saves about ninety-six percent (96%) of that electricity.

2. Wire savings

A typical commercial turf or agricultural design may require two (2) separate valves to be operated simultaneously at a distance of 4,000 feet from the controller. How much wire cost is saved if the proposed invention is used?.

Calculations: [$Vd=I\times R\times L$] Two solenoids each draw 0.7 amps for a total current (I) of 1.4 amps. L is the distance from the controller to the solenoid and back. Therefore, $L=4$ (thousand)$\times 2=8$. The resistance (R) factors for various gauges of wire are as follows:

14 gauge=2.53
12 gauge=1.59
10 gauge=1.00
8 gauge=0.63
6 gauge=0.40

As previously discussed, a minimum of 20 volts AC is required to reliably operate the solenoids. Current controllers provide 24 volts AC. This means that Vd cannot exceed $24-20=4$ volts AC.

Applying these factors to the above equation gives the following results for 10 gauge, 8 gauge and 6 gauge wire:

10 gauge wire ($R=1.00$): $Vd=1.4\times 1.0\times 8=11.2$ This far exceeds 4, and is therefore is unacceptably high.

8 gauge wire ($R=0.63$): $Vd=1.4\times 0.63\times 8=7.05$ This far exceeds 4, and is therefore is unacceptably high.

6 gauge wire ($R=0.40$): $Vd=1.4\times 0.40\times 8=4.48$ This still exceeds 4, but is at least marginally close.

However, the current required by the present invention (I) is only $0.025\times 2=0.05$. Applying this factor and utilizing the resistance (R) of 2.53 for 14 gauge wire results in the following: $Vd=0.05\times 2.53\times 8=1.01$. This is well within the margin of 4 volts and allows the use of thinner 14 gauge wire!

The above example translates into a significant wire cost savings. 6 gauge wire costs approximately $180.00 per thousand feet; 8000 feet of 6 gauge wire would therefore cost $1,440.00. 14 gauge wire costs approximately $40.00 per thousand feet; 8000 feet of 14 gauge wire would therefore cost $320.00. The difference of $1,120.00 translates to a savings of over 77% in wiring costs!

3. Labor Savings

The present invention allows the use of 14 gauge wire which is much thinner, lighter and easier to handle and install than wire of gauge 10 or less.

4. Solenoid savings

There is virtually no risk of overheating of the solenoid utilizing the present invention since it only receives two pulses (one for activation, and one for deactivation) and the solenoid is separated from the main circuit of the controller. Thus the need to repair or replace the solenoid is greatly diminished.

5. Positive activation

The forceful discharge of the capacitor of the present invention into the solenoid coil ensures a much greater reliability of activation of the solenoid.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A circuit for energizing a latching solenoid on an AC (alternating current line comprising a rectifier means connected to said AC line, said rectifier having two output leads, first and second activatable switching means, each respectively controlling a first and second set of contacts, a biasing means separating said switching means, four DC charge storage means, the first of which is connected in parallel with said output leads, the second of which is connected in series between both switching means and one output lead wherein the combination of the second charge storage means, the pair of switching means, and the biasing means are in parallel with said first DC charge storage means, the third of which is connected in a line closed by said first switching means, and the fourth of which is connected to a line opened by said second switching means; a first resistance means connected between said one output lead and said second switching means; a second resistance means connected in between said one output lead and said first set of contacts, a second biasing means in series between said second resistance means and said second set of contacts, said latching solenoid having separate activation and deactivation terminals, said activation terminal connected to a line leading from said first set of contacts and said deactivation terminal connected to a line leading form said second set of contacts; whereby low voltage AC power applied to said circuit causes the solenoid to latch open, very low voltage AC power is required to keep said solenoid latched open, and when the AC power is removed the solenoid latches closed.

2. The circuit described in claim 1 above wherein as low current AC voltage is placed across said rectifier means, DC current flows to the first and second switching means causing their contacts, respectively, to close and open, resulting in the storage of a charge in each of said third and fourth DC charge storage means; whereupon, when said second DC charge storage means becomes fully charged, the first switching means drops out releasing the first set of contacts controlled thereby and causing said third charged DC charge storage means to discharge into the activation terminal of said solenoid, tripping the solenoid to open; thereafter, so long as a minimal current limited by said first resistance means flows through said circuit, the second switching means remains activated, keeping the second set of contacts open; whereupon, when all voltage to the circuit is eliminated, said second switching means drops out closing said second set of contacts resulting in the discharge of the fourth charged DC charge storage means directed by said second biasing means into the deactivation terminal of said solenoid, tripping the solenoid to close.

3. A circuit for energizing a latching solenoid on an AC (alternating current) line comprising:

a. said latching solenoid having an activation terminal and a deactivation terminal;

b. a rectifier means connected in said circuit for providing a DC (direct current) supply from the AC line;

c. a first DC charge storage means and a first activatable switching means connected in said circuit to said rectifier means, said switching means controlling a first set of contacts in line with the activation terminal of said solenoid;

d. a biasing means and a second activatable switching means connected in said circuit in series to said first DC charge storage means, said second switching means controlling a second set of contacts in line with the deactivation terminal of said solenoid;

e. a first resistance means connected in said circuit in series with said second switching means, bypassing said first DC storage means;

f. a second resistance means and a second DC charge storage means connected in said circuit to said rectifier means, said second resistance means separated from said second DC charge storage means by the contacts controlled by said first switching means;

g. a second biasing means and a third DC charge storage means connected in series with said second resistance means and in parallel with said second DC charge storage means and said first set of contacts;

h. a line originating at the second set of contacts and connected between said second biasing means and said third DC charge storage means;

i. a line originating at the first set of contacts controlled by said first switching means terminating at the activation terminal of said solenoid; and j. a ground line exiting said solenoid connected back to said rectifier means.

4. The circuit described in claim 3 above wherein said first switching means controls the first set of three contacts, and said second switching means controls the second set of two contacts.

5. The circuit described in claim 3 above wherein as AC voltage is placed across said rectifier means, DC current is sent to each of the first and second switching means causing their controlled contacts, respectively, to close and open, resulting in a charge to be stored in said second and third DC charge storage means; whereupon, after a time interval said first DC charge storage means becomes fully charged, causing said first switching means to drop out releasing said first set of contacts and causing said second DC charge storage means to discharge into the activation terminal of said solenoid, tripping the solenoid to open; thereafter, so long as a minimal current is sent through said first resistor means, said second switching means remains activated, keeping said second set of contacts open; whereupon, when all voltage to the circuit is eliminated, said second switching means drops out closing said second set of contacts resulting in the discharge of said third DC charge storage means directed by said second biasing means into the deactivation terminal of said solenoid, tripping the solenoid to close.

6. A circuit for energizing a latching solenoid on an AC (alternating current) line comprising a rectifier means connected to said AC line and having output leads, a single switching means coupled to the output leads of said rectifier for controlling a set of three contacts, a biasing means in a line between said solenoid and one output lead of the rectifier, three DC charge storage means, the first of which is connected in parallel to the output leads of said rectifier, the second of which is connected in series between said one output lead of said rectifier and said switching means, and in parallel with a resistor means, and the third of which is connected to a line which includes contacts controlled by said switching means; said latching solenoid having separate activation and deactivation terminals, said activation terminal connected to the third DC charge storage means, and said deactivation terminal connected to the line leading from said contacts controlled by said switching means whereby low voltage AC power applied to said circuit causes the solenoid to latch open, very low voltage AC power is required to keep said solenoid latched open, and when the AC power is removed the solenoid latches closed.

7. The circuit described in claim 6 above wherein as AC voltage is placed across said rectifier means, DC current is sent through the second DC charge storage means to the switching means activating it and causing two of its three contacts to close leaving the remaining contact open, thereby allowing DC current to charge said third DC charge storage means in series with the activation terminal of the solenoid, tripping the solenoid open; whereupon, as said third DC charge storage means becomes fully charged, the current to said solenoid is interrupted and said biasing means preventing discharge backwards away from the solenoid; meanwhile, said switching means remains activated by low current flowing through said resistor means; whereupon, when all voltage to the circuit is eliminated, said switching means drops out closing the open contact resulting in the discharge of said third DC charge storage means into the deactivation terminal of said solenoid, tripping the solenoid to close.

8. A circuit for energizing a latching solenoid on an AC (alternating current) line comprising:

a. said latching solenoid having an activation terminal and a deactivation terminal;

b. a rectifier means connected in said circuit for providing a DC (direct current) supply from the AC line;

c. a first DC charge storage means and a switching means connected in said circuit to said rectifier means, said switching means controlling a set of three contacts in line with the activation and deactivation terminals of said solenoid;

d. a first resistance means connected in said circuit in series with said switching means, bypassing said first DC storage means;

e. a biasing means in said circuit in series between said rectifier means and said first contact;

f. a second DC charge storage means connected in said circuit between said second contact and the activation terminal of said solenoid;

g. a line originating at the third of said contacts and terminating at the deactivation terminal of said solenoid; and h. a ground line exiting said solenoid connected back to said rectifier means.

9. The circuit described in claim 8 above wherein as AC voltage is placed across said rectifier means, DC current is sent to the switching means causing its first and second contacts to close, resulting in a charge being stored in said second DC charge storage means, while current is applied to the activation terminal of the solenoid it is tripped open; whereupon, when each of the DC charge storage means becomes fully charged, the circuit through each of them is broken said biasing means preventing discharge of the second DC charge storage means backwards away from the solenoid; thereafter, so long as a minimal current is sent through said resistor means, said switching means remains activated, keeping said contacts closed; whereupon, when all voltage to the circuit is eliminated, said switching means drops out opening said contacts resulting in the discharge of said second DC charge storage means into the deactivation terminal of said solenoid, tripping the solenoid to close.

10. A circuit for energizing a bipolar latching solenoid on an AC (alternating current) line comprising a rectifier means connected to said AC line, a single switching means coupled to output leads of said rectifier controlling two sets of three contacts, a resistor means coupled in said circuit with said switching means, a biasing means in series with the first set of contacts and one of the output leads, and three DC charge storage means, the first of which is connected in parallel to the output leads, the second of which is connected between said switching means and said one output lead and in parallel with the resistor means, and the third of which is connected in series between said first set of contacts and an input terminal of a latching solenoid; a line leading from said first set of contacts to the second set of contacts, a line leading from an output terminal of said latching solenoid to said second set of contacts, and a line originating between said third DC charge storage means and said input terminal leading to said second set of contacts, whereby low voltage AC power applied to said circuit causes the solenoid to latch open, very low voltage AC power is required to keep said solenoid latched open, and when the AC power is removed the solenoid latches closed.

11. The circuit described in claim 10 above wherein as AC voltage is placed across said rectifier means, DC current is sent through the second DC charge storage means to the switching means activating it and causing two of the three contacts of each set to close, thereby allowing DC current directed by said biasing means to charge said third DC charge storage means in series with the input terminal of the solenoid, tripping the solenoid open; whereupon, when said third DC charge storage means becomes fully charged, the current to said solenoid is interrupted; meanwhile, said switching means remains activated by minimal current flowing through said resistor means; whereupon, when all voltage to the circuit is eliminated, said switching means drops out closing the open contacts of each set, resulting in the discharge of said third DC charge storage means into the output terminal of said solenoid, tripping the solenoid to close.

12. A circuit for energizing a bipolar latching solenoid on an AC (alternating current) line comprising:

a. said latching solenoid having an input terminal and an output terminal;

b. a rectifier means connected in said circuit for providing a DC (direct current) supply from the AC line;

c. a first DC charge storage means and a switching means connected in said circuit to said rectifier means, said switching means controlling two sets of three contacts, the first set in line with the input terminal of said solenoid and the second set in line with the output terminal of said solenoid;

d. a resistance means connected in said circuit in series with said switching means, bypassing said first DC storage means;

e. a biasing means in said circuit between said rectifier means and the first contact of the first set of contacts;

f. a second DC charge storage means connected in said circuit between the second of the contacts of said first set and the input terminal of said solenoid;

g. a line originating at the third contact of said first set of contacts and terminating at the first contact of the second set of contacts;

h. a line originating at the output terminal of said solenoid and terminating in the line leading to the first contact of the second set of contacts;

i. a line originating in the line between said second DC charge storage means and the input terminal of said solenoid and terminating at the second contact of the second set of contacts; and j. a ground line leading from the third contact of said second set of contacts back to said rectifier.

13. The circuit described in claim 12 above wherein as AC voltage is placed across said rectifier means, DC current is sent to the switching means activating it and causing two contacts in each of the sets of contacts to close leaving one contact in each set open, resulting in the completion of a circuit passing from said rectifier through said biasing means across said first set of contacts, then through said second DC charge storage means, then through the input terminal of said latching solenoid, exiting through the output terminal thereof crossing said second set of contacts and returning to said rectifier such that the solenoid is tripped open and a charge is stored in said second DC charge storage means; whereupon, when each of the DC charge storage means becomes fully charged, the circuit through each of them is broken; thereafter, so long as a minimal current is sent through said resistor means, said switching means remains activated, keeping said contacts closed; whereupon, when all voltage to the circuit is eliminated, said switching means drops out closing two different contacts in each of the two sets of contacts resulting in the completion of a different circuit through which the discharge of said second DC charge storage means into the output terminal of said solenoid is accomplished, tripping the solenoid to close.

* * * * *